US007887039B2

(12) United States Patent
Lee et al.

(10) Patent No.: US 7,887,039 B2
(45) Date of Patent: Feb. 15, 2011

(54) IMAGE FORMING APPARATUS

(75) Inventors: Jin Soo Lee, Suwon-si (KR); Byung Sun Ahn, Suwon-si (KR); Jae Yong Kim, Suwon-si (KR); Ki Hun Kim, Yongin-si (KR)

(73) Assignee: Samsung Electronics Co. Ltd, Suwon-si (KR)

( * ) Notice: Subject to any disclaimer, the term of this patent is extended or adjusted under 35 U.S.C. 154(b) by 290 days.

(21) Appl. No.: 11/746,837

(22) Filed: May 10, 2007

(65) Prior Publication Data

US 2008/0093795 A1 Apr. 24, 2008

(30) Foreign Application Priority Data

Oct. 20, 2006 (KR) ..... 10-2006-0102529

(51) Int. Cl.
*B65H 5/26* (2006.01)

(52) U.S. Cl. ..... 271/9.09

(58) Field of Classification Search ..... 271/9.09
See application file for complete search history.

(56) References Cited

U.S. PATENT DOCUMENTS

| | | | | |
|---|---|---|---|---|
| 3,957,366 | A | 5/1976 | Taylor et al. | |
| 5,779,235 | A * | 7/1998 | Nakamura | 271/9.09 |
| 6,011,948 | A * | 1/2000 | Amano et al. | 399/395 |
| 6,267,368 | B1 * | 7/2001 | Tomoe et al. | 271/9.09 |
| 2004/0028438 | A1 | 2/2004 | Shin | |
| 2005/0073085 | A1 * | 4/2005 | Fukada et al. | 271/9.09 |
| 2005/0238398 | A1 * | 10/2005 | Aono | 399/388 |

FOREIGN PATENT DOCUMENTS

| | | |
|---|---|---|
| EP | A-0 546 722 | 6/1993 |
| EP | A-0 782 967 | 7/1997 |
| JP | 2005-154129 | 6/2005 |
| KR | 2002-62397 | 7/2002 |

OTHER PUBLICATIONS

European Search Report dated Jun. 19, 2008 issued in EP 07108424.8.
Chinese Office Action issued Apr. 3, 2009 in CN 2007101104135.

* cited by examiner

*Primary Examiner*—Stefanos Karmis
*Assistant Examiner*—Michael C McCullough
(74) *Attorney, Agent, or Firm*—Stanzione & Kim LLP

(57) ABSTRACT

An image forming apparatus, which can efficiently align a paper supplied to a printing unit of a main body from a paper feeding unit that is removably mounted to the main body, includes a paper aligning unit, integrally provided with a paper container of the paper feeding unit, to align the paper supplied to the main body and thereby prevent paper misalignment. The paper container to automatically feed paper, the paper supply case to manually feed paper, and the paper aligning unit to align the supplied paper and to supply the paper to the main body are integrally provided within the paper feeding unit to reduce the number of components and thereby decrease manufacturing costs, increase efficiency, and increase productivity.

18 Claims, 6 Drawing Sheets

IMAGE FORMING APPARATUS

CROSS-REFERENCE TO RELATED APPLICATIONS

This application claims the priority of Korean Patent Application No. 2006-0102529, filed on Oct. 20, 2006 in the Korean Intellectual Property Office, the disclosure of which is incorporated herein by reference.

BACKGROUND OF THE INVENTION

1. Field of the Invention

The present general inventive concept relates to an image forming apparatus, and more particularly to an image forming apparatus equipped with a paper feeding unit that supplies a paper to a printing unit inside a main body.

2. Description of the Related Art

An image forming apparatus, such as a laser printer, an ink jet printer, a multi-function printer, a copying machine and the like, generally includes a main body, a printing unit mounted inside the main body, a paper feeding unit which supplies a paper to the printing unit, and a discharging unit which discharges a printed paper out of the main body. The printing unit forms an image and prints the image on the paper by using toner or ink according to a printing process.

The paper feeding unit includes a cassette type paper loading device or a tray type paper loading device, as well as a pickup roller which picks up the paper loaded on the paper loading device sheet by sheet, a feed roller which feeds the picked-up paper to the printing unit, and a register roller which aligns a front end of the transferred paper between the feed roller and the printing unit. The cassette type paper loading device is loaded with paper having the same size for automatic paper feeding, and is ideal for relatively large, routine print jobs. The tray type paper loading device is also loaded with paper, but allows a user to swiftly and manually load one or more sheets of paper of varying size as needed, which makes the tray type paper loading device ideal for relatively small, non-routine print jobs.

During the printing process, paper loaded on the paper loading device is picked up by the pickup roller, and transferred along a paper print path by the feed roller. The paper is aligned in a width direction by the register roller in the main body, and moved to the printing unit. After being printed, the paper is discharged out of the main body by the discharging unit.

However, in the paper feeding operation of a conventional image forming apparatus, the paper is picked up from the paper loading device and transferred to the printing unit by the register roller provided at the main body, which is problematic since the paper is often distorted between the paper loading device and the main body whose frames are separately provided. As such, the paper is frequently required to be realigned.

Also, because the cassette type paper loading device is removably mounted to the main body for the automatic paper feeding, the tray type paper loading device provided at the main body for the manual paper feeding and the register roller provided at the main body for the paper alignment are formed at different frames, which results in an increased number of components, increased manufacturing costs, and decreased manufacturing efficiency.

SUMMARY OF THE INVENTION

The present general inventive concept has been made in order to solve the above problems. It is an aspect of the present general inventive concept to provide an image forming apparatus which is equipped with a paper feeding unit capable of efficiently aligning a paper supplied to a printing unit from a paper feeding unit that is removably mounted to a main body.

It is another aspect of the present general inventive concept to provide an image forming apparatus which can reduce manufacturing costs, increase ease of use, and increase work efficiency.

Additional aspects and/or advantages of the present general inventive concept will be set forth in part in the description which follows and, in part, will be obvious from the description, or may be learned by practice of the present generally inventive concept.

The foregoing and/or other aspects and utilities of the present general inventive concept may be achieved by providing an image forming apparatus which includes a main body and a paper feeding unit removably mounted to the main body and having a paper container and a paper aligning unit which aligns a picked-up paper from the paper container and supplies the picked-up paper to the main body.

The paper aligning unit may include a register roller which feeds the picked-up paper, and a pivotable shutter that is opened upon contact with a front end of an aligned paper.

The paper feeding unit further may include a paper supply case to manually supply the paper to the main body.

The manually supplied paper from the paper supply case may be transferred to the main body via the paper aligning unit.

The main body may be provided with a return path for to enable two-sided printing, wherein a paper with print on only one surface is transferred to the paper aligning unit via the paper supply case along the return path.

The paper with print on only one surface may be transferred to the paper supply case along the return path.

The foregoing and/or other aspects and utilities of the present general inventive concept may also be achieved by providing an image forming apparatus having a main body and a paper feeding unit removably mounted to the main body to supply paper, the paper feeding unit including a paper container to automatically feed paper, and a paper supply case to manually feed paper, a paper aligning unit to align the paper supplied from the paper contained and the paper supply case, and to supply paper to the main body, wherein the paper container, the paper supply case, and the paper aligning unit are removably mounted to the main body as a single unit.

The automatically-fed paper from the paper container and the manually-fed paper from the paper supply case may be aligned by the paper aligning unit.

At least one of the paper container and the paper supply case may be provided with feed rollers, and the paper aligning unit is provided at one of the feed rollers.

Feed rollers may be situated on the paper supply case and the paper container may include the paper aligning unit.

The main body may be provided with a return path for two-sided printing, and a paper with print on one surface is transferred to the feed rollers along the return path.

The foregoing and/or other aspects and utilities of the present general inventive concept may also be achieved by providing an image forming apparatus which includes a main body and a paper feeding unit removably mounted to the main body to supply a paper, the paper feeding unit including a paper aligning unit to align and supply the paper to the main body, a first print path to supply paper to the main body from the paper container, and a second print path to supply paper to the main body from the paper supply case.

The paper feeding unit may include a third print path to divert paper printed on one surface back to the main body so that the paper printed on one surface can be printed on a second surface, wherein the third print path extends through the paper aligning unit.

The third print path may intersect the second print path within the paper supply case.

The first print path and the second print path may intersect at the paper aligning unit.

The paper aligning unit may include a shutter having a single paper-abutment surface to abut a misaligned paper traveling from one of the paper container and the paper supply case.

The paper-abutment surface may be a concave surface.

The paper aligning unit may further include a fourth print path that is situated between the first print path and the second print path, and intersects with the first print path and the second print path at the paper aligning unit, and the paper aligning unit aligns paper that originates from any one of the first print path, the second print path, and the fourth print path.

The foregoing and/or other aspects and utilities of the present general inventive concept may also be achieved by providing an image forming apparatus which includes a main body, a paper feeding unit including a paper container to automatically feed paper, a paper supply case to manually feed paper, a paper aligning unit to align paper supplied from one of the paper container and the paper supply case, and a shutter to abut a misaligned paper traveling from one of the paper container and the paper supply case, wherein the paper feeding unit is removably mounted to the main body.

The shutter may include a concave paper-abutment surface to abut a misaligned paper.

The foregoing and/or other aspects and utilities of the present general inventive concept may also be achieved by providing a paper feeding unit of an imaging forming apparatus, the paper feeding unit including a bracket, a paper container formed on a portion of the bracket to contain a sheet of paper, a pair of rollers rotatably mounted on a second portion of the bracket to receive the paper from the container, and a shutter rotatably mounted on the bracket to be in a closed position to close a path between the rollers when a portion of a front end of the paper contacts the shutter, and to be in an open position when the portion of the front end and a second portion of the front end of the paper contact the shutter.

The foregoing and/or other aspects and utilities of the present general inventive concept may also be achieved by providing a method of feeding a paper through an image forming apparatus which includes a main body and a paper feeding unit having a paper container for automatic paper feeding and a paper supply case for manual paper feeding and removably mounted to the main body, the method including supplying paper to the main body from the paper container via a first print path, supplying paper to the main body from the paper supply case via a second print patch, and aligning the paper supplied to the main body from one of the first print path and the second print path via a paper aligning unit, wherein the first print path and the second print path extend through the paper aligning unit.

The method may include the operation of diverting a paper printed on one surface back to the main body via a third print path so that the paper printed on one surface can be printed on a second surface, wherein the third print path extends through the paper aligning unit.

The method may include the operation of abutting a misaligned paper with a shutter having a single paper-abutment surface, wherein the misaligned paper is supplied from one of the paper container and the paper supply case.

BRIEF DESCRIPTION OF THE DRAWINGS

These and/or other aspects and utilities of the exemplary embodiments of the present general inventive concept will become apparent and more readily appreciated from the following description of the embodiments, taken in conjunction with the accompanying drawings, of which.

DETAILED DESCRIPTION OF THE PREFERRED EMBODIMENTS

Figure 1:
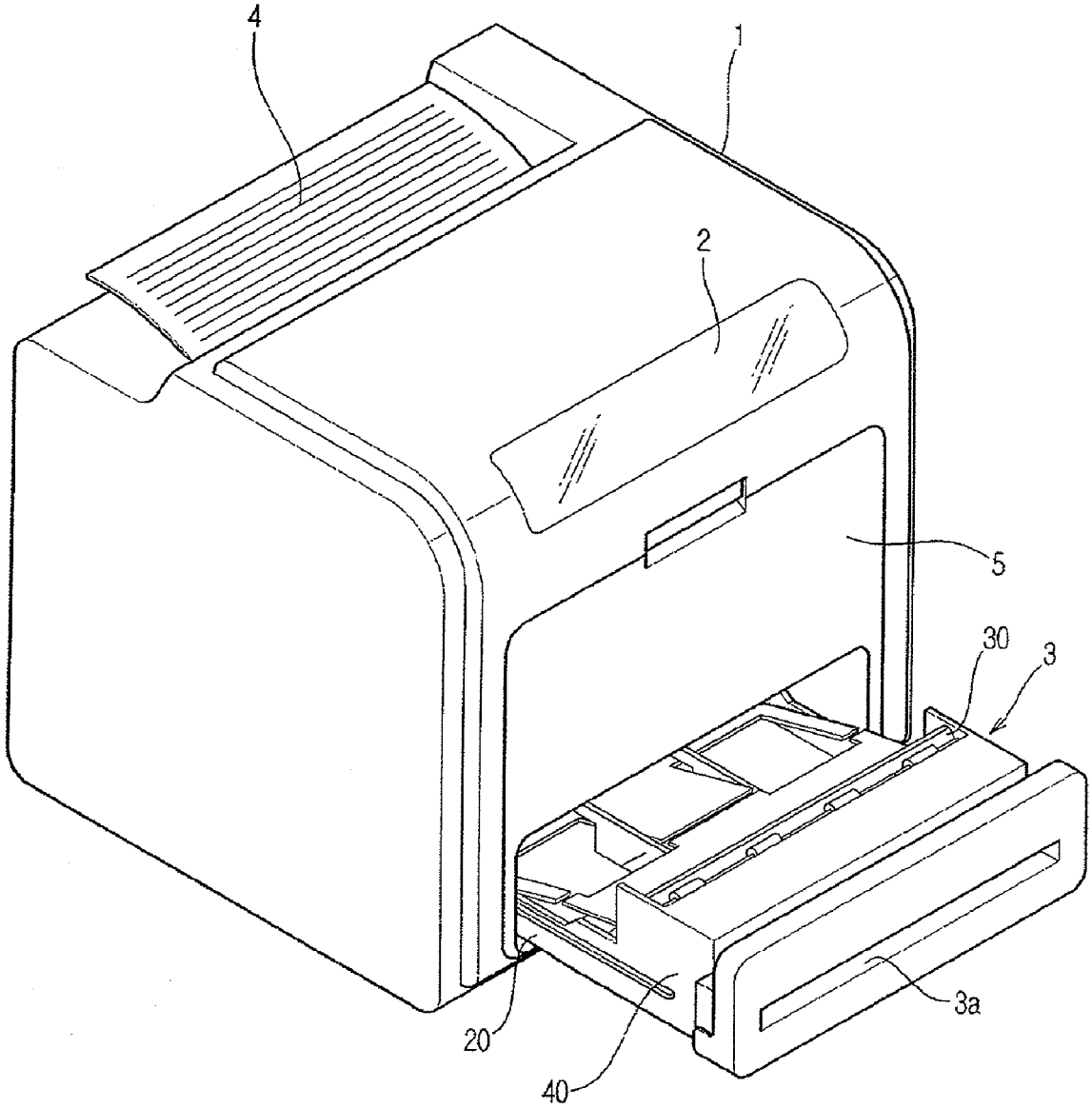
FIG. 1 is a perspective view illustrating an exterior of an image forming apparatus in accordance with an embodiment of the present general inventive concept.

Reference will now be made in detail to exemplary embodiments of the present general inventive concept, examples of which are illustrated in the accompanying drawings, wherein like reference numerals refer to like elements throughout. The embodiments are described below to explain the present general inventive concept by referring to the figures.

Figure 2:
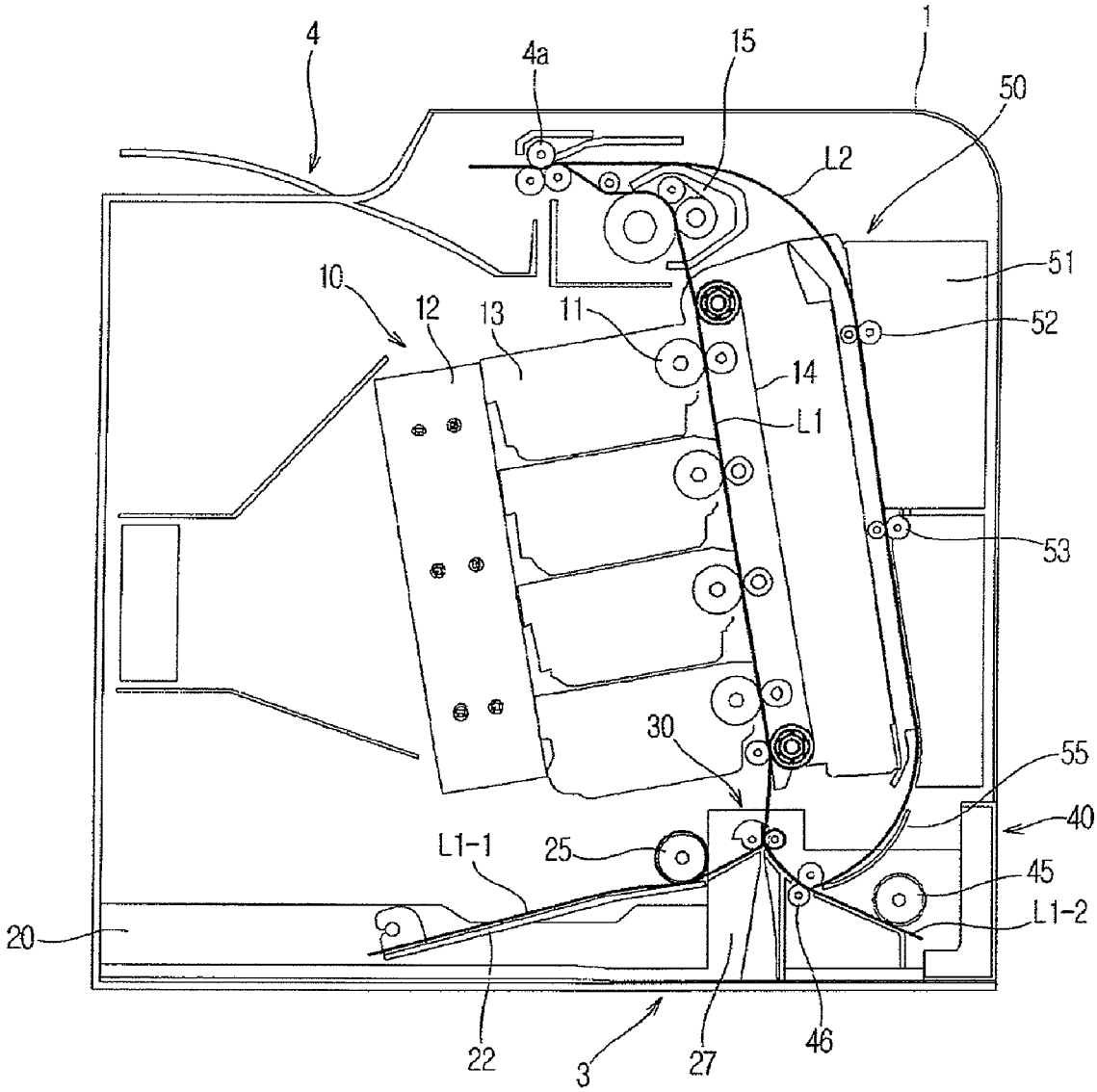
FIG. 2 is a side-sectional view schematically illustrating an interior of an image forming apparatus in accordance with an embodiment of the present general inventive concept.

FIG. 1 is a perspective view illustrating an image forming apparatus in accordance with an embodiment of the present general inventive concept, and FIG. 2 is a side-sectional view schematically illustrating an interior of the image forming apparatus depicted in FIG. 1.

Referring to FIGS. 1 and 2, an image forming apparatus according to the present general inventive concept includes a main body 1 which forms an external housing and is provided with an operation/display panel 2, a paper feeding unit 3 which is removably mounted to a lower portion of the main body 1 to supply a paper, and a discharging unit 4 which discharges a printed paper to an upper portion of the main body 1.

A manual paper feeding tray 5 is hingedly mounted to a front portion of the main body 1, so as to allow a user to promptly load one or more sheets of paper or paper of varying sizes thereon as needed. The paper manually loaded on the opened tray 5 is transferred into the main body 1 through a paper supply slot 3*a* formed at the paper feeding unit 3.

A printing unit 10 is provided inside the main body 1, so as to form a color image on the paper supplied from the paper feeding unit 3. The printing unit 10 includes an exposure part 12 and a developing part 13, which form a color toner image on a photosensitive drum 11. It is foreseen that the color toner image can be of a single color or a plurality of colors including, but not limited to yellow, magenta, cyan and black and/or combinations thereof. The printing unit 10 further includes a transfer part 14 which transfers the toner image formed on the photosensitive drum 11 to the paper, and a fixing part 15 which heat-pressure fixes the toner image transferred to the paper.

Figure 3:
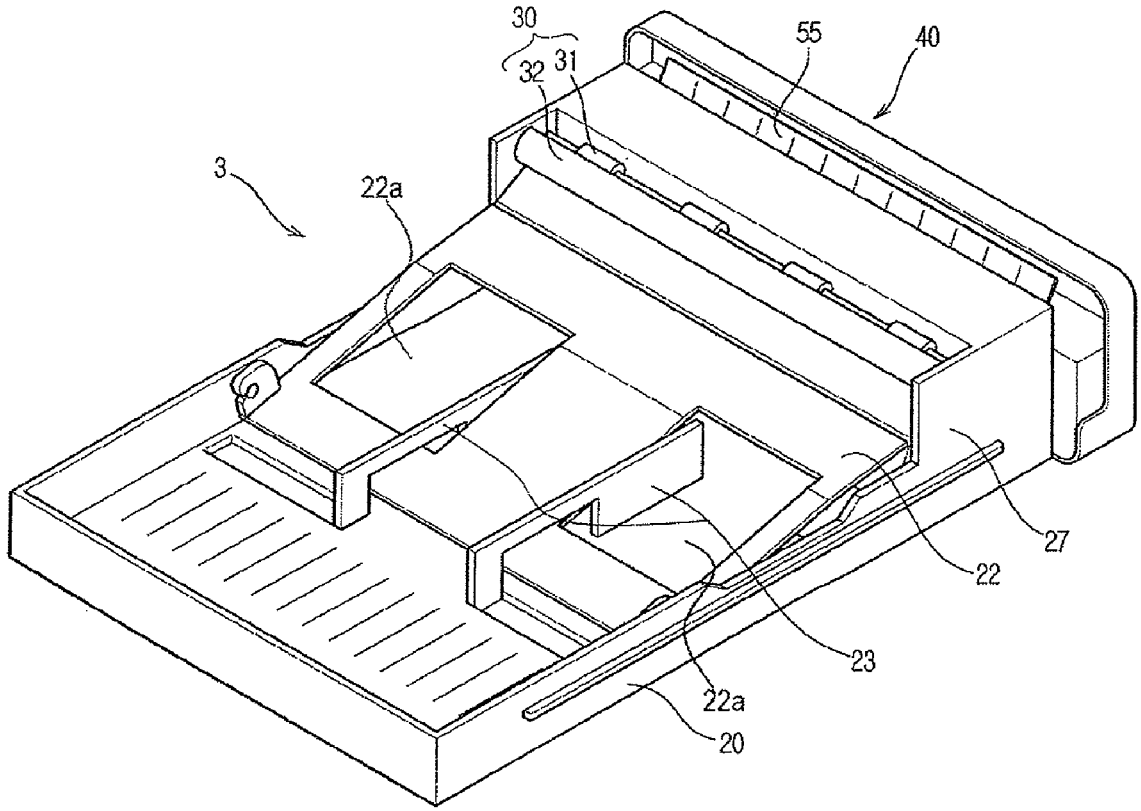
FIG. 3 is a perspective view illustrating a paper feeding unit of an image forming apparatus in accordance with an embodiment of the present general inventive concept.

FIG. 3 illustrates the paper feeding unit which is removably mounted to the image forming apparatus according to the present general inventive concept. Referring to the drawing, the paper feeding unit 3 includes a paper container 20, which contains paper to be automatically supplied, a pickup roller 25, which picks up the paper contained in the paper container 20, and a paper aligning unit 30, which aligns the paper picked up by the pickup roller 25 and feeds the aligned paper to the printing unit 10.

The paper container 20 provides a storage space to store in a feeding direction a plurality of sheets of paper therein, and a knockup plate 22 is provided in the storage space of the paper container 20. One end portion of the knockup plate 22 is pivotably coupled to the paper container 20, and the other end portion of the knockup plate 22 is elastically supported to be biased upward by an elastic member (not shown). Also, the paper container 20 is provided with a pair of opposing width adjusting plates 23 to align the paper loaded in the paper container 20 in a width direction of the paper, which may be perpendicular to the feeding direction. Accordingly, when the paper is loaded in the paper container 20, a front end of the paper is lifted up by the knockup plate 22 and directed toward the paper aligning unit 30. One end of the adjusting plate 23 is movably disposed into the paper container 20, and the other end of the adjusting plate 23 is extended from the one end and disposed to guide the paper through and/or across an opening 22*a* formed on the knock-up plate 22.

The pickup roller 25 is provided in the main body 1, and is rotated to pick up the paper sheet by sheet at which point the front end of the paper is lifted upward by the knockup plate 22, and to supply the paper to the paper aligning unit 30 in the feeding direction. In order to prevent malfunctions during the paper supply process, it is foreseen that a feed roller (not shown) may be provided between the pickup roller 25 and the paper aligning unit 30 in order to guide the paper to the paper aligning unit 30 in the event that the front end of a sheet of paper does not reach the paper aligning unit 30 within one rotation of the pickup roller 25.

Figure 4:
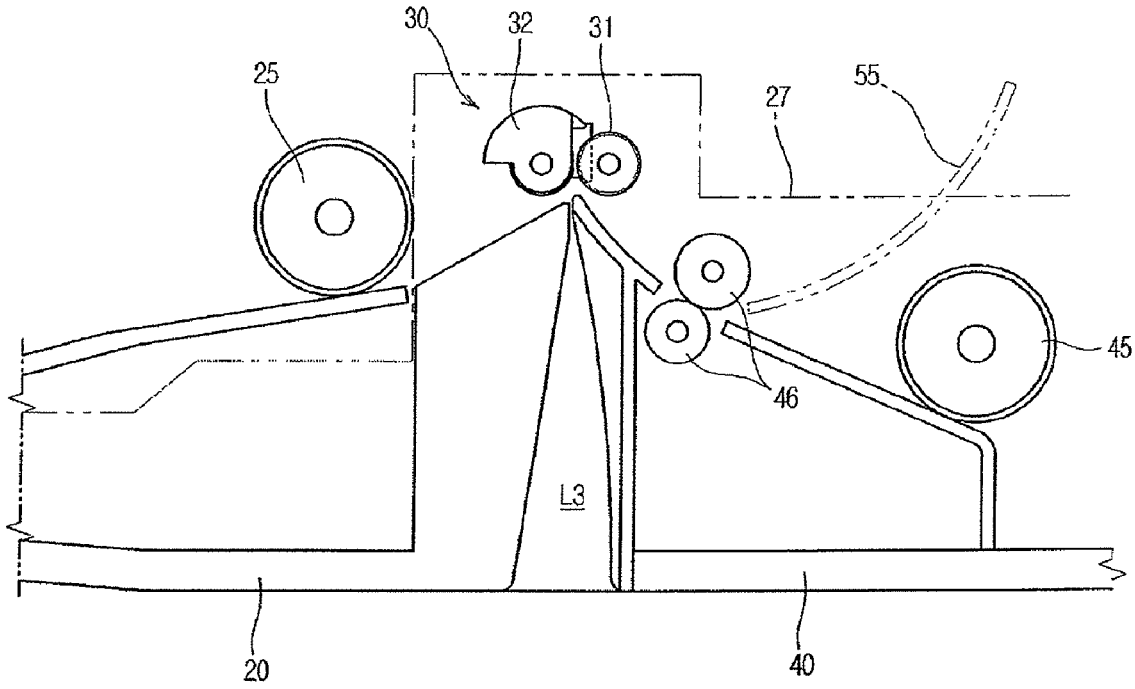
FIG. 4 is a schematic sectional view illustrating a paper feeding unit of an image forming apparatus in accordance with an embodiment of the present general inventive concept.
Figure 5:
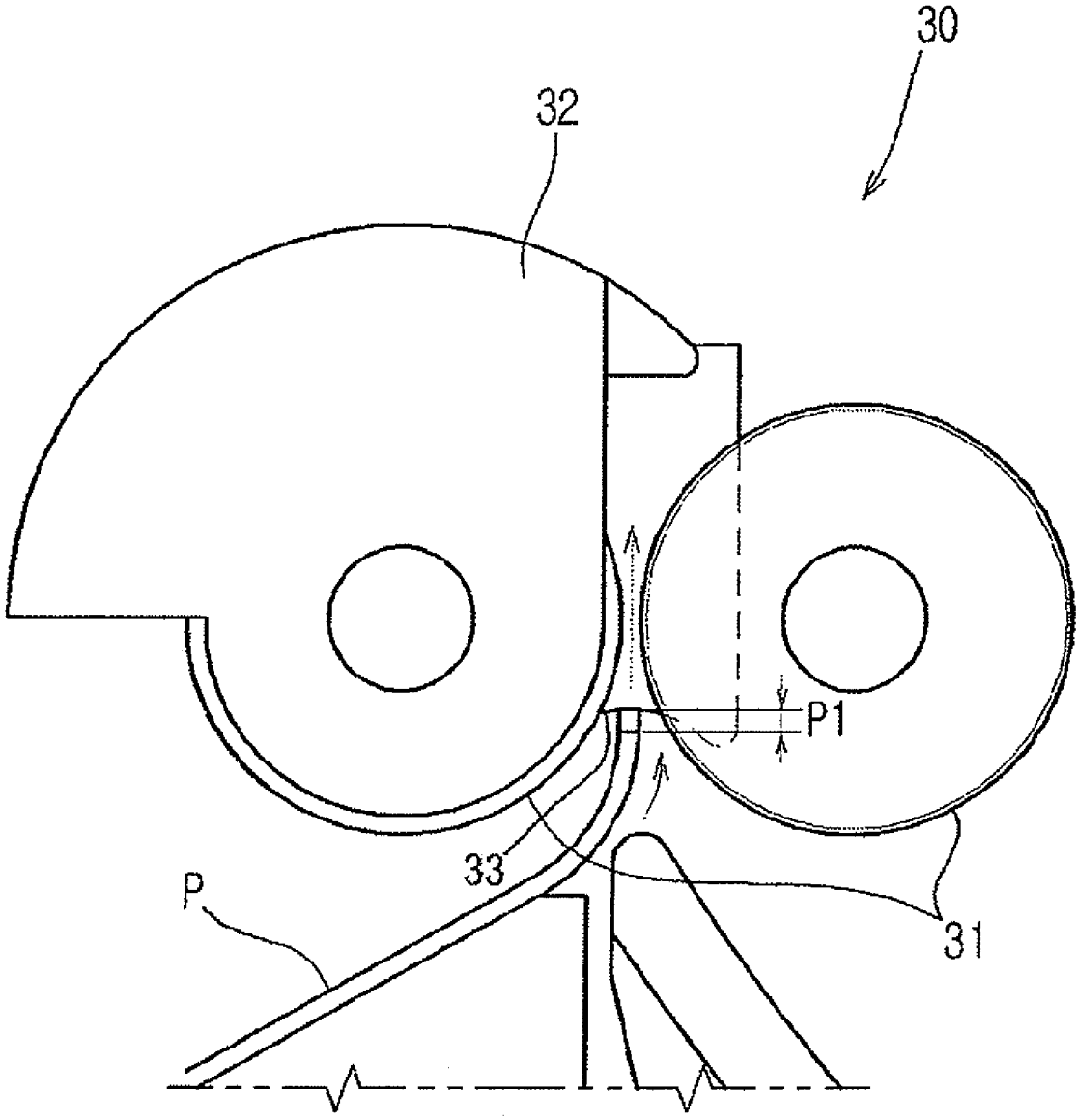
FIGS. 5 and 6 are views illustrating a paper aligning unit of a paper feeding unit of an image forming apparatus in accordance with an embodiment of the present general inventive concept.
Figure 6:
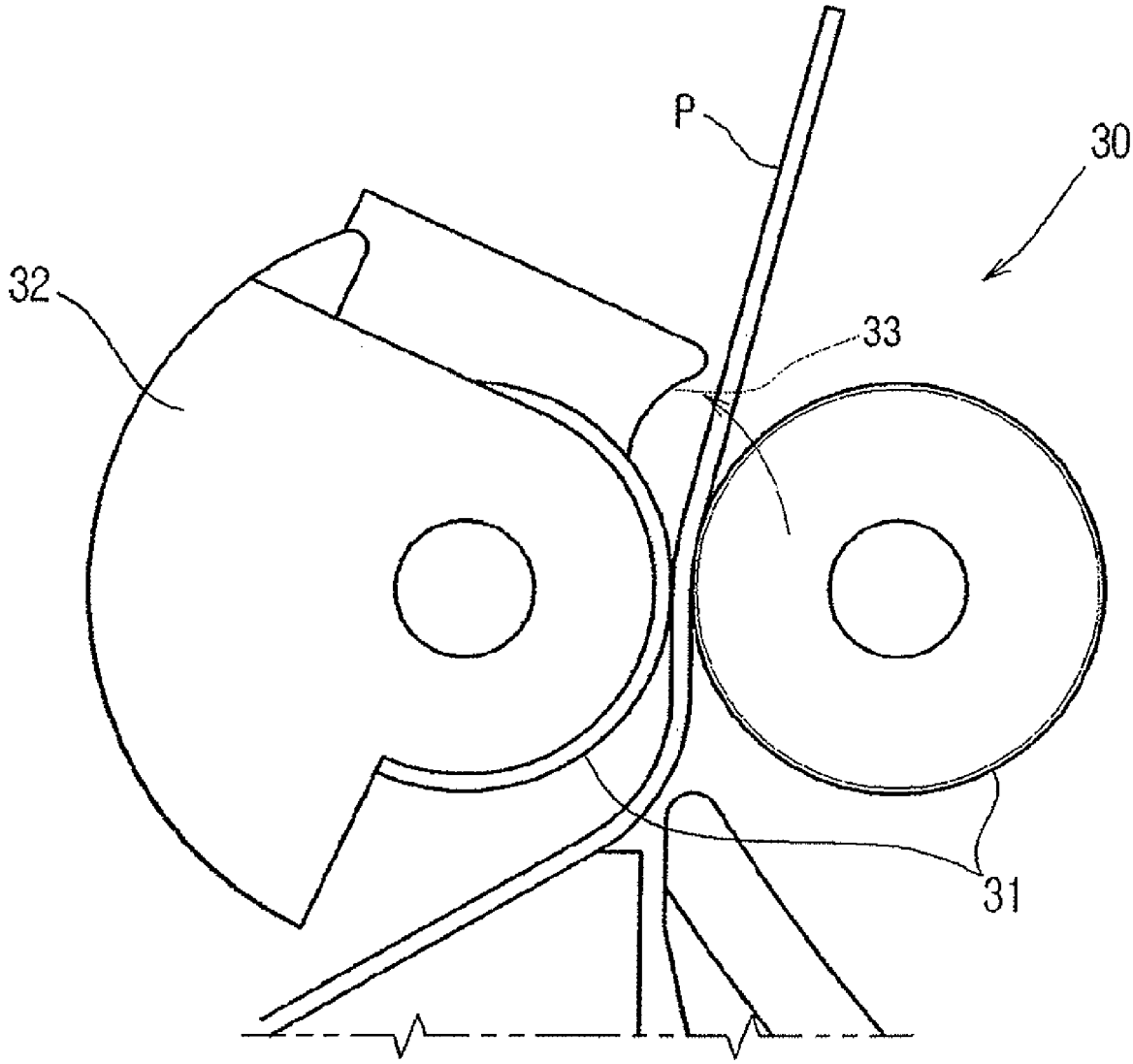

As illustrated in FIG. 4, the paper aligning unit 30 is provided at the paper container 20, and includes register rollers 31 and a shutter 32 in order to align the paper fed by the pickup roller 25 and supply the paper to the printing unit 10 of the main body 1. The register rollers 31 are provided in pairs and feed the picked-up paper. The shutter 32 is coaxially disposed at the register rollers 31. The shutter 32 is pivotably coupled to the paper container 20, and configured such that the shutter 32 opens upon contact with a front end of an aligned paper. When the shutter 32 is in a closed position, as illustrated in FIGS. 4 and 5, the misaligned paper is adjusted by the shutter 32. When the shutter 32 is in an open position, as illustrated in FIG. 6, the paper is allowed to pass therethrough.

The paper aligning unit 30 is mounted on a paper print path L1-1 between the pickup roller 25 and the printing unit 10. The paper aligning unit 30 is supported by a bracket 27, and positioned along the paper print path L1-1 and after the knockup plate 22 in the feeding direction of the paper and at the upper portion of the paper container 20, as illustrated in FIG. 2.

According to the present general inventive concept, the paper container 20 of the paper feeding unit 3 is provided with a paper supply case 40 for manually supplying the paper. As illustrated in FIGS. 3 and 4, the paper supply case 40 and the paper container 20 are integral with the paper feeding unit 3 and removably mounted with the paper feeding unit 3 as a single unit.

Similar to the paper container 20, the paper supply case 40 supplies paper loaded on the tray 5 to the paper aligning unit 30 by using a pickup roller 45 and feed rollers 46. It is foreseen that the feed rollers 46 may be selectively mounted in order to smoothly feed the paper as well as to prevent malfunctions during the paper supply process, such as if the front end of a sheet of paper does not reach the paper aligning unit 30 within one rotation of the pickup roller 45. The pickup roller 45 and the feed rollers 46 are sequentially mounted before the paper aligning unit 30 along a paper print path L1-2, as illustrated in FIG. 2. When a front end of a misaligned paper is disposed between the resister rollers 31, only a portion of the front end contacts the shutter 32, and a pushing force of the portion of the front end is insufficient to make the shutter 32 pivot from the closed position to the open position. Specifically, the front end of the aligned paper and the misaligned paper has a left side and a right side. The shutter 32 has a weight that blocks the misaligned paper when only one of the left side and the right side contact the shutter 32, thus preventing the misaligned paper from passing. When the misaligned paper is adjusted and aligned by the shutter 32, both the left side and the right side of the aligned paper contact the shutter 32, the aligned paper is able to generate a force sufficient to push the shutter 32 and to make the shutter 32 move from a closed position to an open position so that the aligned paper is fed toward the printing unit 10.

Accordingly, when viewing the paper feeding unit 3 as a whole, the paper aligning unit 30 is disposed between the paper container 20 and the paper supply case 40, the paper container 20 is disposed at the left side of the paper aligning unit 30, and the paper supply case 40 is disposed at the right side of the paper aligning unit 30. When mounting and dismounting the paper feeding unit 3, a user holds the paper supply case 40. Also, the paper supplied through the paper container 20 and the paper supply case 40 passes through the paper aligning unit 30 and is fed to the printing unit 10 of the main body 1 along a paper print path L1.

In order to enable printing on both surfaces of the paper, a two-sided printing unit 50 is provided in the main body 1, which diverts the paper, which has been printed on one surface, back to the printing unit 10.

The two-sided printing unit 50 diverts the paper, which has been printed on one surface, back to the printing unit 10 by reversely feeding the paper using backup rollers 4*a* provided at the discharging unit 4, as illustrated in FIG. 2. The two-sided printing unit 50 supplies the paper to the printing unit 10 along a return path L2, which is facilitated by reverse feed rollers 52 and 53 that are mounted between the front portion of the printing unit 10 and a guide frame 51. In order to supply the paper which has been printed on one surface to the printing unit 10, an exit along the return path L2 is connected to the paper aligning unit 30 of the paper feeding unit 3. Preferably, the exit of the return path L2 is connected to the paper supply case 40 for manual paper supply. More preferably, the exit of the return path L2 is connected to a point between the pickup roller 45 and the feed rollers 46. A reverse feed tray 55 is mounted to the bracket 27 between the pickup roller 45 and the feed rollers 46, in order to guide the paper along the return path L2.

As illustrated in FIG. 4, reference numeral L3 refers to a print path for the paper supplied from a lower paper feeding unit when the paper feeding unit 3 is formed in multi-layers. It is foreseen that the paper feed unit 3 can consist of multiple paper feed unit layers in order to provide increased versatility by allowing a user to load more paper into the image forming apparatus, thereby decreasing the number of times a user is required to reload the image forming apparatus with paper during print jobs, thus increasing efficiency.

Hereinafter, operation of the paper feeding unit of the image forming apparatus according to the present general inventive concept structured as above will be described with reference to FIGS. 5 and 6.

When the paper is automatically supplied from the paper container 20, the paper is fed to the main body 1 along the first print path L1-1. The paper stored in the paper container 20 is fed to the paper aligning unit 30 by the knockup plate 22 and the pickup roller 25. In the case that the front end of the paper is misaligned, the shutter 32 is not opened and the paper abuts a paper abutment surface 33 of the shutter 32, as illustrated by P1 in FIG. 5. If the front end of the paper becomes aligned, the shutter 32 is opened and the paper is fed to the register rollers 31, as illustrated in FIG. 6. Although it is foreseen that the shutter 32 may open and close in various manners, in the present embodiment, the shutter 32 opens by rotating the paper-abutment surface 33 along the print path L1-1 and closes by rotating the paper abutment surface 33 against both print paths L1-1 and L1-2. The paper abutment surface 33 may be a concave paper abatement surface in order to adequately block a misaligned paper that is traveling on either paper print paths L1-1 or L1-2, and thereby prevent a misaligned paper from traveling further into the printing unit 10 along the paper print path Li. By preventing the misaligned paper from traveling further into the printing unit 10 along the paper print path L1, the concave abutment surface 33 facilitates removal of the misaligned paper via user intervention, whereby a user can manually remove the misaligned paper, and/or a misaligned paper expulsion process, whereby the paper expulsion process can automatically eject the misaligned paper.

The paper fed to the register rollers 31 is transferred along the paper print path L1. The toner image is formed and transferred to the paper at the developing part 13 and the transfer part 14 of the printing unit 10. The toner image is then heat-pressure fixed to the paper at the fixing part 15. The printed paper is discharged out of the main body 1 through the discharging unit 4.

The paper fed to the resistor rollers 31 is transferred along the paper print path L1. The toner image is formed and transferred to the paper at the developing part 13 and the transfer part 14 of the printing unit 10. The toner image is then heat-pressure fixed to the paper at the fixing part 15. The printed paper is discharged out of the main body 1 through the discharging unit 4.

When the paper is manually supplied from the paper supply case 40, the paper is fed along the second print path L1-2. The paper loaded on the paper supply case 40 is fed to the paper aligning unit 30 by the pickup roller 45 and the feed rollers 46. The second print path L1-2 intersects the first print path L1-1 at paper print path L1, at which point the paper is subject to the same process regardless of whether the paper originated from the first or second print paths L1-1 or L1-2.

When performing the two-sided printing, the paper, which has been printed on one surface by the above printing process, is diverted back to the paper aligning unit 30 along the return path L2. Before the paper, which has been printed on one surface, is discharged externally and onto the discharging unit 4, the paper is transferred to the lower portion of the main body 1 from the backup rollers 4*a* of the discharging unit 4, along the guide frame 51 forming the return path L2 and the reverse feed rollers 52 and 53. Then, the paper is transferred to the paper supply case 40 along the reverse feed tray 55 provided between the pickup roller 45 and the feed rollers 46 of the paper supply case 40, and fed to the paper aligning unit 30 by the feed rollers 46, at which point the paper enters the paper print path L1, which has been previously described above.

In the above description, it has been explained that the present general inventive concept is applied to a laser printer capable of color print and two-sided print, however, it is foreseen that the present general inventive concept can also be applied to other types of image forming apparatus, such as an ink jet printer, a multi-function printer, a copying machine and the like.

As apparent from the above description, the image forming apparatus of the present general inventive concept can prevent the problem of paper misalignment, which may happen between a separately provided main body and paper containing unit in a conventional image forming apparatus, by integrally providing the paper aligning unit 30 for aligning the paper to be supplied to the printing unit 10 with the paper container 20 of the paper feeding unit 3 as a single unit.

Further, since the paper container 20, the paper supply case 40, and the paper aligning unit 30 are integrally provided within the paper feeding unit 3, which is removable from the main body 1 as a unit, a user is able to easily remove the paper feeding unit 3 in order to inspect the paper aligning unit 30 as well as first and second print paths L1-1 or L1-2, which facilitates maintenance and/or removal of any misaligned papers.

Still further, since the paper container 20, the paper supply case 40, and the paper aligning unit 30 are integrally provided within the paper feeding unit 3, the number of components is reduced, which decreases manufacturing costs, increases ease of use, and thereby increases productivity.

Although embodiments of the present general inventive concept have been illustrated and described, it will be appreciated by those skilled in the art that changes may be made in this embodiment without departing from the principles and spirit of the present general inventive concept, the scope of which is defined in the claims and their equivalents.

What is claimed is:

1. An image forming apparatus comprising:

a main body;

a return path to divert a paper printed on one surface back to the main body so that the paper printed on one surface can be printed on a second surface; and a paper feeding unit removably mounted to the main body and having a paper container with a knock-up plate to lift a front end of paper within the paper container, a paper supply case to manually supply paper to the main body, a paper aligning unit mounted above the knock-up plate to an upper side of the paper container to align a picked-up paper from the paper container and supply the picked-up paper to the main body, the paper aligning unit having a shutter to abut the picked-up paper traveling from the paper container, and a reverse feed tray to guide the paper along the return path, wherein the paper supply case comprises a manually paper feeding path to feed paper to the paper aligning unit, a pickup roller to pick up paper loaded on the paper supply case and feed rollers disposed on the manually paper feeding path between the pickup roller and the shutter, wherein the paper container, the shutter, the reverse feed tray and the feed rollers constitute a unitary unit, and the paper aligning unit, the reverse feed tray, and the feed rollers are mounted to or separated from the main body along with the paper container when the paper feeding unit is mounted to or separated from the main body.

2. The image forming apparatus according to claim 1, wherein the paper aligning unit further comprises:

a pair of register rollers to feed the picked-up paper, wherein the shutter is installed coaxially to one of the register rollers.

3. The image forming apparatus according to claim 2, wherein the paper supply case is disposed in front of the paper container in a direction in which the paper feeding unit is separated from the main body.

4. The image forming apparatus according to claim 3, wherein the manually supplied paper from the paper supply case is transferred to the main body via the paper aligning unit.

5. The image forming apparatus according to claim 3, wherein the paper with print on only one surface is transferred to the paper supply case along the return path.

6. The image forming apparatus according to claim 1, wherein the return path and the manually paper feeding path join at an upstream direction of the feed roller.

7. The image forming apparatus according to claim 1, further comprising:

a developing part to supply toner to a photosensitive drum to form a toner image; and a transfer part to transfer the toner image formed by the photosensitive drum to paper, wherein the paper discharged from the paper aligning unit is supplied between the developing part and the transfer part.

8. An image forming apparatus having a main body, a return path for two-sided printing and a paper feeding unit removably mounted to the main body to supply paper, the paper feeding unit comprising:

a paper container to automatically feed paper with a knock-up plate to lift a front end of paper within the paper container;

a paper supply case to manually feed paper;

a paper aligning unit mounted above the knock-up plate to align paper supplied from the paper container and the paper supply case, and to supply paper to the main body, the paper aligning unit having a pair of register rollers to feed paper and a pivotable shutter installed coaxially to one of the register rollers;

a reverse feed tray to guide the paper along the return path, a pickup roller to pick up paper loaded on the paper supply case; and feed rollers situated on the paper supply case to feed paper to the shutter, wherein the paper container, the paper supply case, the register rollers, the shutter, the reverse feed tray, pickup roller and the feed rollers are removably mounted to the main body as a single unit.

9. The image forming apparatus according to claim 8, wherein the automatically-fed paper from the paper container and the manually-fed paper from the paper supply case are aligned by the paper aligning unit.

10. The image forming apparatus according to claim 8, wherein the paper container includes the paper aligning unit.

11. The image forming apparatus according to claim 10, wherein a paper with print on one surface is transferred to the feed rollers along the return path.

12. An image forming apparatus which includes a main body and a paper feeding unit having a paper container for automatic paper feeding and a paper supply case for manual paper feeding and removably mounted to the main body, the paper feeding unit comprising:

a paper aligning unit to align and supply the paper to the main body, the paper aligning unit having a shutter having a single paper-abutment surface to abut a misaligned paper traveling from one of the paper container and the paper supply case;

a first print path to supply paper to the main body from the paper container;

a second print path to supply paper to the main body from the paper supply case; and a third print path to divert paper printed on one surface back to the main body so that the paper printed on one surface can be printed on a second surface, wherein the paper supply case includes a pickup roller to pick up paper loaded on the paper supply case and feed rollers disposed on the second print path between the pickup roller and the shutter, wherein the paper container, the paper supply case, the shutter, the feed rollers, and a portion of the third print path constitute a unitary unit, and the paper supply case, the shutter, the feed rollers, and the portion of the third print path are mounted to or separated from the main body along with the paper container when the paper feeding unit is mounted to or separated from the main body.

13. The image forming apparatus according to claim 12, wherein the third print path intersects the second print path within the paper supply case.

14. The image forming apparatus according to claim 12, wherein the first print path and the second print path intersect at the paper aligning unit.

15. The image forming apparatus according to claim 12, wherein the paper-abutment surface is a concave surface.

16. The image forming apparatus according to claim 12, wherein the paper aligning unit further comprises:

a fourth print path that is situated between the first print path and the second print path, and intersects with the first print path and the second print path at the paper aligning unit, wherein the paper aligning unit aligns paper that originates from any one of the first print path, the second print path, and the fourth print path.

17. A paper feeding unit of an image forming apparatus having a main body and a return path for two-sided printing, the paper feeding unit comprising:

a paper container to automatically feed paper;

a paper supply case to manually feed paper, the paper supply case being disposed in front of the paper container to constitute part of a front of the main body of the image forming apparatus;

a paper aligning unit disposed between the paper container and the paper supply case to align paper supplied from one of the paper container and the paper supply case, the paper aligning unit having a shutter to abut a misaligned paper traveling from one of the paper container and the paper supply case; and a reverse feed tray to guide the paper along the return path, wherein the paper supply case includes a pickup roller to pick up paper loaded on the paper supply case and feed rollers situated on the paper supply case between the pickup roller and the shutter, wherein the paper feeding unit is removably mounted to the main body and the paper container, the paper supply case, the shutter, the feed rollers, and the reverse feed tray constitute a unitary unit, and wherein the paper supply case, the shutter, the feed rollers, and the reverse feed tray are mounted to or separated from the main body along with the paper container when the paper feeding unit is mounted to or separated from the main body.

18. The paper feeding unit of claim 17, wherein the shutter further comprises:

a concave paper-abutment surface to abut a misaligned paper.

* * * * *